United States Patent [19]

Okamoto et al.

[11] 4,087,017

[45] May 2, 1978

[54] HEAT INSULATING DEVICE FOR LOW TEMPERATURE LIQUIFIED GAS STORAGE TANKS

[75] Inventors: Tomiyasu Okamoto; Tsunanori Nishimoto; Kaoru Sawada; Koji Hayakawa; Tomomichi Kurihara, all of Osaka, Japan

[73] Assignee: Hitachi Shipbuilding & Engineering Co., Ltd., Osaka, Japan

[21] Appl. No.: 722,118

[22] Filed: Sep. 10, 1976

[51] Int. Cl.[2] ..... B65D 87/24

[52] U.S. Cl. ..... 220/445; 220/453

[58] Field of Search ..... 220/9 A, 9 F, 9 LG, 220/10, 15; 62/45, 50, 54; 52/573

[56] References Cited

U.S. PATENT DOCUMENTS

| | | | |
|---|---|---|---|
| 3,411,656 | 11/1968 | Jackson | 220/9 LG X |
| 3,655,086 | 4/1972 | Trenner | 220/9 LG |
| 3,670,917 | 6/1972 | Nishimaki et al. | 220/10 |
| 3,769,118 | 10/1973 | Tariel et al. | 220/9 LG |
| 3,773,604 | 11/1973 | Desai et al. | 220/9 LG X |

FOREIGN PATENT DOCUMENTS

| | | | |
|---|---|---|---|
| 860,817 | 2/1961 | United Kingdom | 220/9 LG |
| 860,816 | 2/1961 | United Kingdom | 220/9 LG |
| 932,581 | 7/1963 | United Kingdom | 220/9 LG |

*Primary Examiner*—Stephen Marcus
*Attorney, Agent, or Firm*—Joseph W. Farley

[57] ABSTRACT

A heat insulating construction for the outer wall of a low temperature liquified gas storage tank comprising a number of blocks or plates of rigid foam insulating material bonded to the outer wall, with seats for receiving pressing jigs for the bonding operation secured to the outer wall in the joints between the insulating blocks. The joints are filled with soft synthetic foam, embedding the seats therein, a moisture-proof layer covers the insulating blocks and joints, and a water-proof material covers the moisture-proof layer.

5 Claims, 3 Drawing Figures

HEAT INSULATING DEVICE FOR LOW TEMPERATURE LIQUIFIED GAS STORAGE TANKS

The present invention relates to a heat insulating device for low temperature liquified gas storage tanks, and more particularly it relates to a heat insulating device for spherical tanks.

A spherical tank for storing low temperature liquified gas has a small outer wall area for its volume and hence it requires a small amount of material and yet it is advantageous from the standpoint of strength. However, since its outer wall surface is a three-dimensional curved surface, the mounting of a heat insulating device on the outer wall surface of such spherical tank presents a number of problems which must be solved, including equalizing the thickness of heat insulating layers and securing and facilitating the attachment thereof; securing heat insulation of junctions between heat insulating blocks; and prevention of sea water or liquified gas from penetrating the heat insulating material even if the ship's hull or the tank is broken.

The main object of the present invention is to provide a heat insulating device which can be simply and securely applied to an outer tank wall surface of such curved surface construction. According to the heat insulating device of the invention, a number of heat insulating block plates of rigid foam resin preformed into a square or trapezoidal shape and having a predetermined thickness are arranged on and bonded to an outer tank wall, seats for pressing jigs used to press said heat insulating block plates against the outer tank wall in bonding them to the latter are disposed in the joints between said heat insulating block plates, and a heat insulating filler is stuffed into said joints with said seat embedded subsequent to the bonding of said heat insulating block plates. According to the present invention, with heat insulating block plates and pressing jigs used, it is possible to attach said block plates to the tank outer wall easily and securely and even if the outer tank wall is curved a heat insulating device extending therealong can be easily formed. Further, since a heat insulating filler is stuffed into the joints between the block plates, there is no possibility of decreasing the heat insulating effect, and since the pressing jigs used in pressing the heat insulating block plates are removable and the seats are arranged to be embedded, the execution of works after bonding is easy.

Further, according to the present invention, since said heat insulating block plates are formed of a rigid foam resin such as rigid urethane foam and these rigid foam resin plates and said joints are covered with moisture-proof layers throughout their surfaces, their surfaces are liquid-tight so that there is no possibility of the heat insulating effect of the rigid foam resin plates being decreased as by the moisture in the atmosphere. According to a desirable embodiment of the invention, the surfaces of said block plates are covered with moisture-proof layers of rigid foam resin applied thereto by spraying or brushing and reinforced by glass mesh, said moisture-proof layers thoroughly preventing the wetting of said block plates. Further, a heat insulating surface having a suitable pressure-resisting strength is formed by the simple procedure of applying water-proof paint or bonding a sheet of water-proof paper or the like to the moisture-proof layer surface. According to this heat insulating construction, the strength required to retain the necessary shape is obtained while securing the necessary thickness, and some amount of thermal expansion and contraction of the tank and the pressure of leakage gas from the tank can be endured. The moisture-proof layer desirably has a laminated construction consisting of spray-formed polyurethane foam and glass mesh but other materials may also be used, there being no restrictions on the materials.

Other numerous features and merits of the present invention will be readily understood from the following description of a preferred embodiment of the invention with reference to the accompanying drawings.

IN THE DRAWINGS

Figure 1:
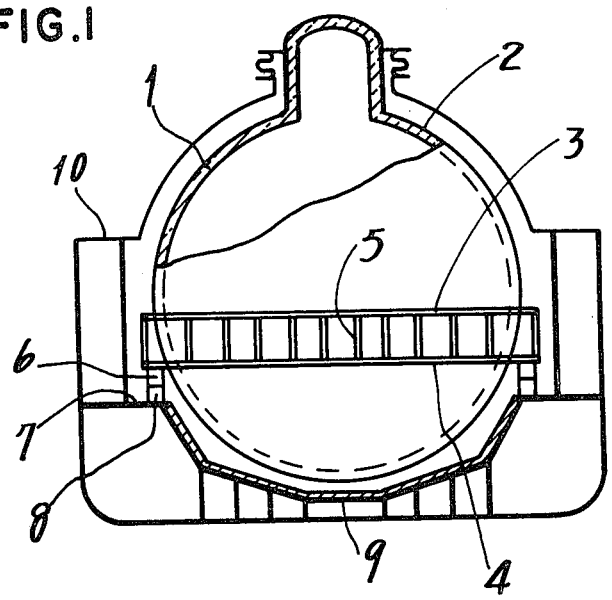
FIG. 1 is a broken-away cross-sectional view of a low temperature liquified gas carrrying vessel having a spherical tank.

In FIG. 1, the character 1 is an outer tank wall; 2, a heat insulating device attached to the surface of the outer tank wall 1; 3 and 4, upper and lower horizontal support rings horizontally projecting from the outer tank wall 1 and disposed in the vicinity of the equator of the tank and in a circumferential position spaced therebelow; and 5 is a stiffener interposed between said upper and lower rings 3 and 4. Designated at 6 are support chocks circumferentially equispaced and fixed to the lower surfaces of the lower support ring 4, said support chocks being placed on support blocks 8 fixed on a support deck 7, with a suitable pressure-resistant heat insulating material interposed therebetween. Such support arrangement allows the expansion and contraction of the tank. The character 9 designates a secondary wall heat insulating device and 10 designates an upper deck.

Figure 2:
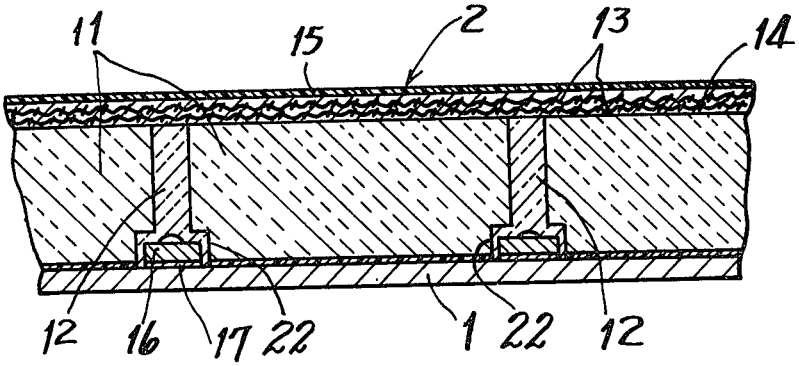
FIG. 2 is a cross-sectional view of a heat insulating device.

The heat insulating device 2, whose details are shown in FIG. 2, comprises a number of heat insulating block plates 11 of a rigid foam synthetic resin such as a rigid urethane foam suitably arranged on and bonded to an outer tank wall 1, the joints between said rigid foam resin block plates being filled with a heat insulating filler 12 consisting of an adhesive agent or soft foam synthetic resin, the entire surfaces of said rigid foam resin block plates and joints being covered with a moisture-proof layer 14 consisting of an alternate lamination of a moisture-proof material in the form of a rigid foam resin, applied by spraying or brushing, and glass mesh 13, the surface thereof being further covered with a sheet-like water-proof layer 15. Designated at 16 is a seat for a pressing jig used for pressing said block plates 11 against said outer tank wall 1 in bonding the rigid foam resin block plates 11 to the outer tank wall 1, said seat being fixed to the outer tank wall 1 through a seat plate 17 of non-woven fabric or the like and being embedded in the heat insulating device 2 by the filler 12 after use. The block plates 11 are provided with notches 22 to receive the seats 16.

The order of construction will now be described.

Figure 3:
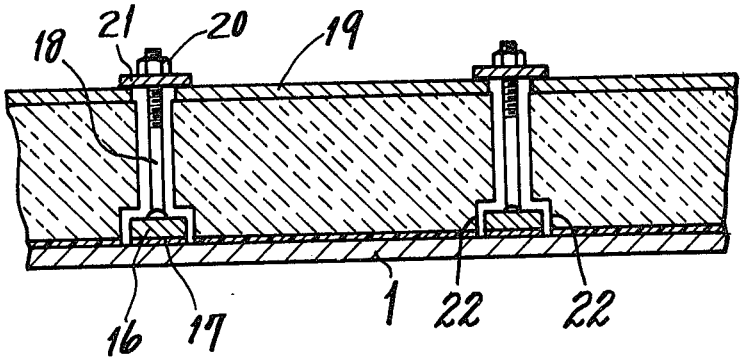
FIG. 3 is a sectional view showing the intermediate step during the assembly of the heat insulating device.

First of all, as shown in FIG. 3, a plurality of seats 16 allowing the setting and removal of stems 18 are adhesively secured at suitable places on the surface of the outer tank wall 1 through the seat plate 17. The stems 18 are then set upright by fixing their front ends to said seats 16 and the rigid foam resin blocks 11 are adhesively bonded to the outer tank wall 1 between said seats 16. Until the adhesive agent sets, reinforcing plywood sheets 19 respectively placed on the rigid foam resin blocks 11 are held being pressed toward the outer tank wall 1 by nuts 20 threadedly fitted on the stems 18. Plywood washers 21 fitted on the stems 18 are interposed between the nuts 20 and the reinforcing plywood sheets 19. After the adhesive agent has set, the nuts 20, plywood washers 21 and reinforcing plywood sheets 19 are removed and the stems 18 are then removed. The joints between the rigid foam resin block plates 11 are filled with the heat insulating filler 12, and in this case the seats 16 remain in the heat insulating device 2 as they are embedded along with the filler 12. Next, polyurethane foam serving as moisture-proof material is applied to the entire surface and the glass mesh 13 is applied thereon, followed by the application of the moisture-proof material, the two being alternately applied in layers to form a moisture-proof layer 14. Finally, water-proof paint is applied to the surface of said moisture-proof layer 14 or water-proof paper is bonded thereto form a water-proof layer 15.

We claim:

1. In a heat insulating device for the outer surface of a spherical low temperature liquified gas storage tank, the improvement comprising:

a plurality of rigid foam synthetic resin block plates bonded to said outer tank surface with joint spaces between adjacent block plates;

means for pressing said block plates against said outer tank surface during the bonding of said block plates thereto, said pressing means including seat means secured to said outer tank surface in said joint spaces and pressing jigs detachably engageable with said seat means and with the outer surfaces of said block plates, said block plates being notched to receive said seat means;

a heat insulating filler of soft foam synthetic resin inserted in said joint spaces and embedding said seat means; and moisture-proof means covering said block plates and said filler, said moisture-proof means comprising a laminate of glass mesh and polyurethane foam and a water-proof material covering said laminate.

2. A heat insulating device as set forth in claim 1, wherein said rigid foam resin is rigid urethane foam.

3. A heat insulating device as set forth in claim 1, wherein said moisture-proof means include polyurethane foam.

4. A heat insulating device as set forth in claim 3, wherein said polyurethane foam is applied by spraying.

5. A heat insulating device as set forth in claim 3, wherein said polyurethane foam is applied by brushing.

* * * * *